United States Patent [19]

Absenger

[11] Patent Number: 4,993,381

[45] Date of Patent: Feb. 19, 1991

[54] INTERNAL COMBUSTION ENGINE HAVING A SOUND-DAMPING CASING

[75] Inventor: Erich Absenger, Passau, Fed. Rep. of Germany

[73] Assignee: Motorenfabrik Hatz GmbH & Co. KG, Ruhstorf, Fed. Rep. of Germany

[21] Appl. No.: 406,709

[22] Filed: Sep. 13, 1989

[30] Foreign Application Priority Data

Sep. 15, 1988 [DE] Fed. Rep. of Germany ..... 3831334

[51] Int. Cl.[5] ..... F02B 77/00

[52] U.S. Cl. ..... 123/198 E; 123/41.7; 181/204

[58] Field of Search ..... 123/41.62, 41.65, 41.66, 123/47.7, 195 R, 195 C, 195 S, 198 E; 181/204

[56] References Cited

U.S. PATENT DOCUMENTS

| | | | |
|---|---|---|---|
| 3,276,539 | 10/1966 | Deer et al. | 181/204 |
| 3,530,840 | 9/1970 | Freyn | 123/41.65 |
| 3,601,101 | 8/1971 | Thien | 123/41.7 |
| 4,516,657 | 5/1985 | Allard | 181/204 |
| 4,548,164 | 10/1985 | Ylonen | 123/195 C |

FOREIGN PATENT DOCUMENTS

| | | | |
|---|---|---|---|
| 1576775 | 3/1970 | Fed. Rep. of Germany . | |
| 2804028 | 8/1979 | Fed. Rep. of Germany | 123/41.65 |
| 3104534 | 8/1982 | Fed. Rep. of Germany . | |

OTHER PUBLICATIONS

Hatz Diesel "Typenblatt" Specification; 1/1980; Hatz Diesel, Ruhstorf, West Germany.

Hatz Diesel English Specification 6/1987 and 12/1987; Hatz Diesel, Ruhstorf, West Germany.

*Primary Examiner*—Noah P. Kamen

*Attorney, Agent, or Firm*—Flynn, Thiel, Boutell & Tanis

[57] ABSTRACT

An internal combustion engine has a casing which includes interconnected elements and is connected to an engine housing with interposed vibration-damping means. The engine also has a cooling air blower driven by an engine crankshaft which draws in cooling air through an inlet opening in said casing and conveys such cooling air through an interior space between the engine housing and the casing. Exhaust air from such interior space exits through an outlet opening in said casing, the inlet and outlet openings being disposed in a single element of the casing which element is a closed unit at a side of the engine remote from the blower and is equipped with at least one sound-damping layer. The sound-damping layer has casing element passages formed therein which are separate from one another and which communicate said interior space respectively with the inlet and outlet openings.

5 Claims, 2 Drawing Sheets

INTERNAL COMBUSTION ENGINE HAVING A SOUND-DAMPING CASING

FIELD OF THE INVENTION

The invention relates to an internal combustion engine and, more particularly, to an improved casing therefor.

BACKGROUND OF THE INVENTION

A known internal combustion engine has a casing which comprises interconnected elements and which is connected to the engine housing with interposed vibration-damping means and has a cooling air blower driven by the engine crankshaft, which blower draws in cooling air through an inlet opening in the casing and conveys it through the interior space between the engine housing and the casing, the exhaust air exiting through an outlet opening provided in the casing. An object of the invention is to design the casing in such a way that it ensures an optimum flow of cooling air along the outer surfaces of the engine, enables economic manufacture and assembly, and allows necessary maintenance work on the engine to be performed with minimum expense.

It is an object of the invention to provide access through the casing to the transmission means, coupled to the engine crankshaft, for various external units in such a way that the sound-damping effect of the casing is scarcely impaired thereby.

SUMMARY OF THE INVENTION

In accordance with the invention, inlet and outlet openings are disposed in a single element of the casing, which casing element is disposed as a closure for the casing that side of the engine which is remote from the blower side. The casing element is equipped with at least one sound-damping layer through which extends in the casing element, passages which are separate from one another and respectively communicate with the inlet and outlet openings.

In accordance with the invention, access openings are provided in the casing element and in its sound-damping layer in the region of the end of the crankshaft on the control side, which access openings are closable by a removable cover which, after it has been removed, affords access to transmission means which are disposed in the region and are coupled to the crankshaft for, for example, driving external units.

In this connection, it is advantageous to secure the cover directly to said casing element. When the cover is removed, the interior of the casing is shielded towards the outside in such a way that the part of the engine housing which faces the openings carries a cover plate on which an edge of the sound-damping layer rests in a sealing manner.

BRIEF DESCRIPTION OF THE DRAWINGS

The invention is further described hereinafter, by way of example with reference to the accompanying drawings, in which.

DETAILED DESCRIPTION

Figure 1:
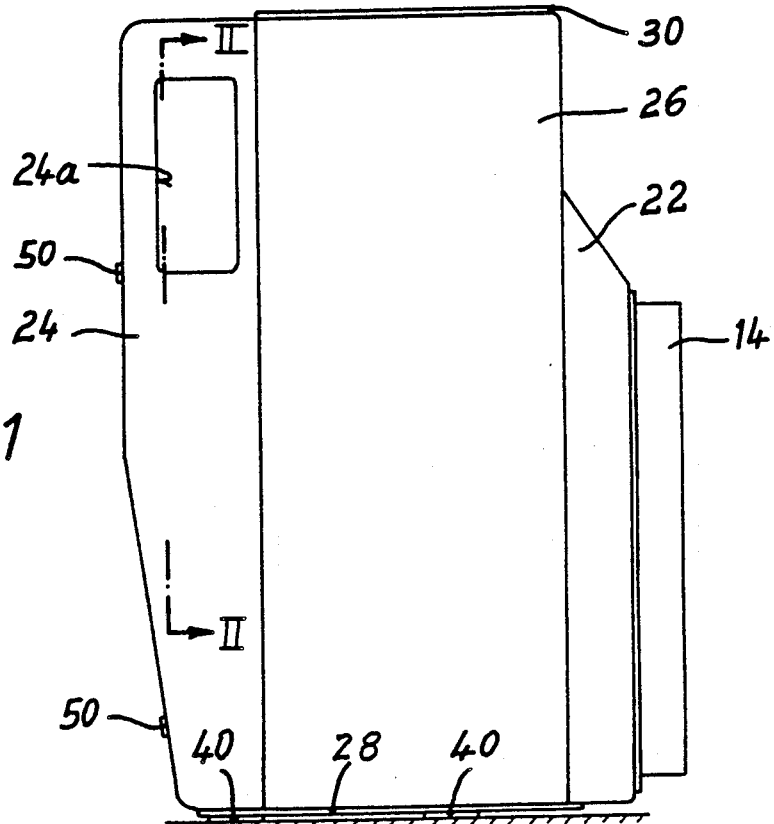
FIG. 1 is a view of the casing.

A single-cylinder, vertical internal combustion engine illustrated comprises a cylinder 10 and a cylinder head 12 which, in a known manner, are securely clamped to a crankcase 14 to form an engine block or housing. The cylinder head 12 carries a cover 16 which closes the top of the space for the valve rocker arms. One end 18*a* of the crankshaft 18 journalled in the crankcase 14 extends through the crankcase 14 where it carries a flywheel 20 which, in a known manner, is in the form of an impeller of a cooling air blower.

A multi-part casing entirely surrounding the engine housing is provided for the purpose of damping the sounds emanating from the engine during operation. The casing comprises a panel 22 disposed on the flywheel side, a panel 24 located on the control side, two panels 26 on the narrow sides of the engine, a bottom panel 28 and a top covering panel 30. These casing elements 22–30 are in the form of thin-walled sheet metal parts and are interconnected in a conventional manner not illustrated.

The casing elements 22–30 are carried by the engine housing 10, 12, 14 by means of two support strips 32, 34 secured to the cylinder head 12 with interposed vibration-damping means 38 (rubber strips). The bottom panel 28 includes four support feet 40, rigidly connected to the engine housing, with interposed rubber rings 42, a respective spring 41 being inserted between the bottom panel 28 and the crankcase 14.

The panel 24 is a dished element of one-piece construction and is provided with two rectangular openings 24*a*, 24*e*. A sound-damping layer 44 of, for example, rock wool is mounted on the inside of the panel 24 in such a way that two passages 44*e*, 44*a*, separated from one another, are created in the layer. The self-contained passage 44*e* commences from the opening 24*e*, then leads downwardly substantially towards the axis of the cylinder and opens laterally at 44*ef* to the bottom region of the casing. The passage 44*a* is also self-contained and extends substantially in a horizontal direction and leads into the opening 24*a*. A lateral opening 44*af* constitutes the connection between the passage 44*a* and the interior space of the casing. Hence, the two passages 44*a*, 44*e* are entirely separated from one another, although they are open towards the interior space of the casing.

Figure 2:
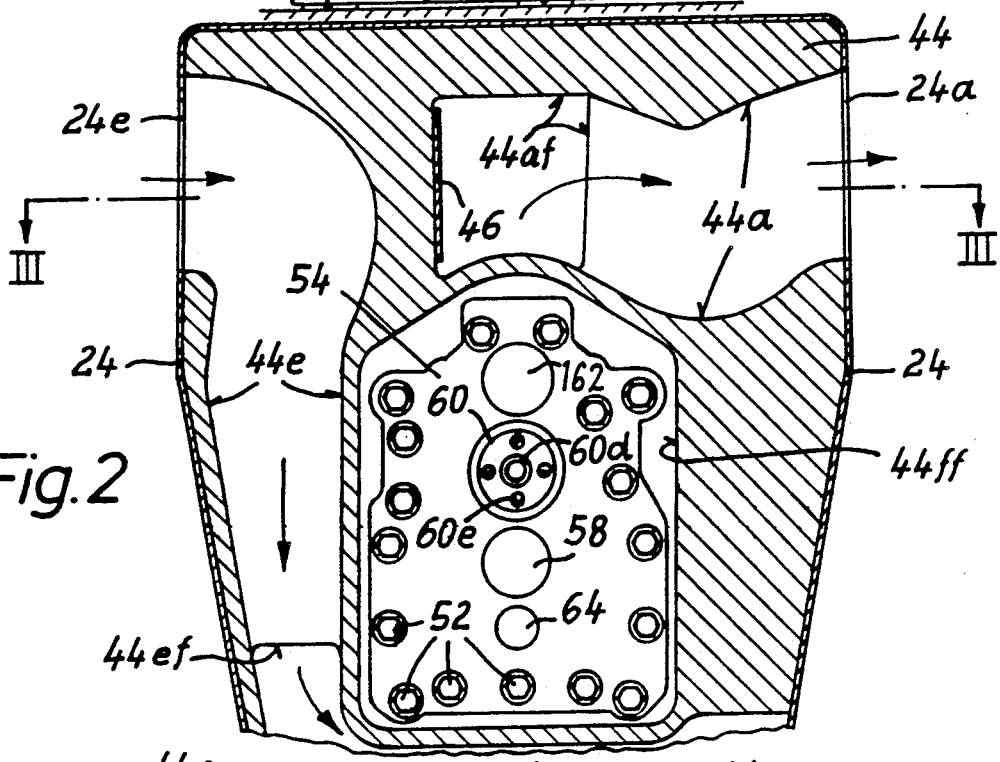
FIG. 2 is a section taken on the line II—II of FIG. 1.
Figure 3:
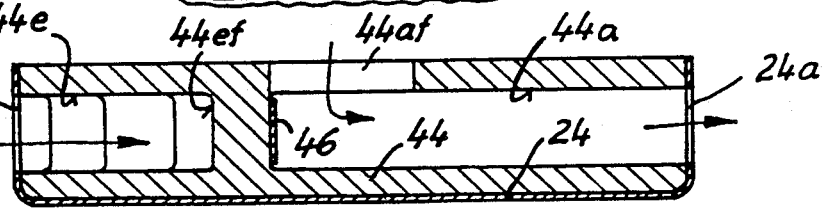
FIG. 3 is a section taken on the line III—III of FIG. 2.
Figure 4:
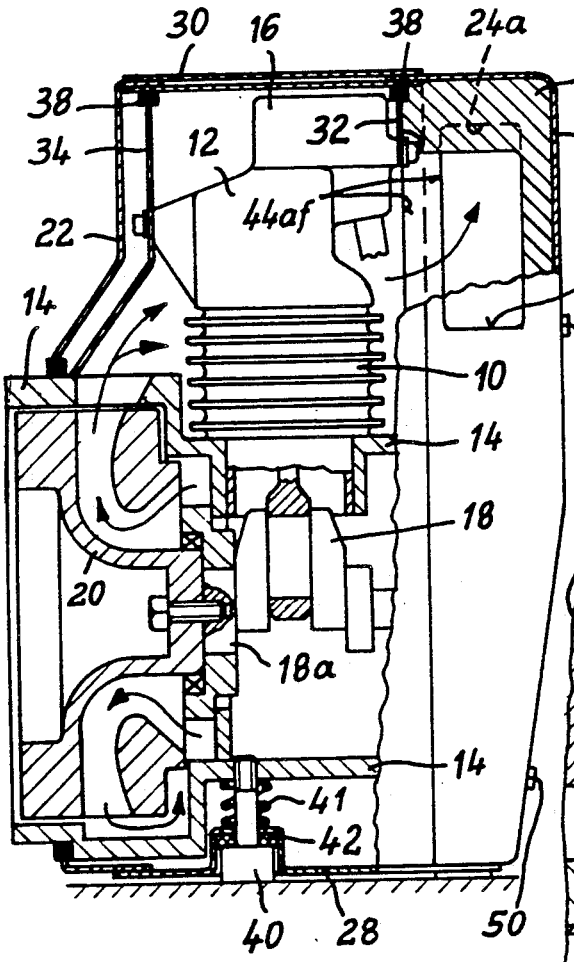
FIG. 4 is a fragmentary longitudinal section through the engine and casing.
Figure 5:
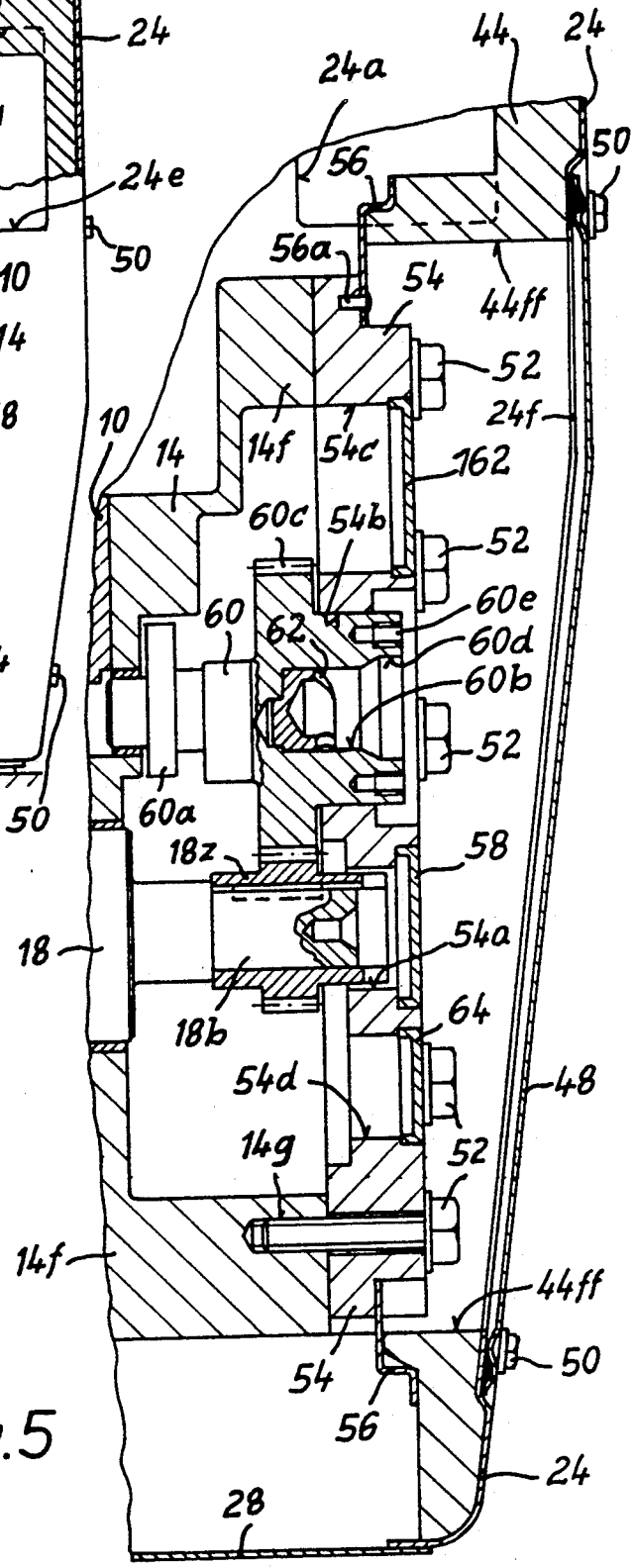
FIG. 5 is an enlarged cross section through the transmission means on the control side.

The blower 20 draws in the fresh air, flowing into the lower interior space of the casing through the passage 44*e* and its opening 44*ef*, and conveys it upwardly along the outer surfaces of the engine housing 10, 12, 14, as is indicated by arrows in FIG. 4. The exhaust air flows from the interior of the casing through the opening 44*af* and into the passage 44*a*, then to the outlet opening 24*a* where it emerges from the casing, as is indicated by arrows in FIG. 2. If required, additional thermal shielding of the seams between the passage 44*e* carrying the cool air and the passage 44*a* carrying the hot exhaust air may be provided by heat-resistant material, for example by gluing foils 46 at such locations.

The construction, in accordance with the invention, of mutually separated inlet and outlet passages in a single panel has many advantages. On the one hand, such panels, together with their layer, may be manufactured with a minimum of expense and they may be mounted on the engine in an extremely simple manner. When the panel is removed, for maintenance purposes for example, the interior of the casing is clearly visible and readily accessible.

This construction also enables the fresh air to flow around and cool the crankcase filled with lubricating oil even before reaching the blower 20, so that an oil cooler otherwise required may be omitted. Furthermore, the air filter for the combustion air may be disposed within the casing in such a way that it is located in the region of flow of the fresh air coming from the passage 44*e*, and thus only receives cool air. If required, air baffle plates may also be provided within the casing to conduct the cooling air directly to the components of the engine which are subjected to high thermal stress, such as the exhaust silencer. It may also be mentioned that the casing is secured by means of the support strips 32, 34 to that location of the engine (cylinder head) at which only a low level of solid-borne sound prevails, so that scarcely any solid-borne sound is transmitted from this region.

The cross-sectional dimensions of the two passages 44*e*, 44*a* formed in the panel 24 must be sufficient not to hinder the required flow of cooling air. The passages must also be of adequate length to enable their silencing effect to damp to the desired extent the engine noise emerging from the interior of the casing through these passages and into the open air. The surfaces, facing the engine, of the layers forming the passages can be brought very close to the contours of the engine and, in this manner, the dimensions of the panel carrying them may be kept extremely small.

A further advantageous development of the casing element 24 will now be described. This panel 24 has an opening 24*f* in the region surrounding the end 18*b* of the crankshaft on the control side, an opening 44*ff* of the same shape also being provided in the sound-damping layer 44 of this panel. The circumferential shape of the two openings may be seen in FIG. 2. The openings are covered by a cover 48 which is releasably secured to the exterior of the panel 24 by means of screws 50.

The crankcase 14 on its control side has a flange 14*f* in which a number of screw-threaded holes 14*g* are formed. A support plate 54 is secured to the flange 14*f* by means of screws 52 engaging the screw-threaded holes. An annular cover plate 56 is secured to the support plate 54 by means of, for example, several rivets 56*a*. The edge of the layer 44 forming the opening 44*ff* rests sealingly on the cover plate 56 under slight pressure, so that the interior of the casing remains reliably shielded towards the outside when the cover 48 is removed.

The support plate 54 has several openings which are all accessible after the cover 48 has been removed. The opening 54*a* receives the end of a gear wheel 18*z* which is mounted on the end 18*b* of the crankshaft and which is coupled thereto for rotary movement. Torque may be derived directly from the crankshaft from here for the purpose of driving auxiliary units which, for example, are flange-mounted onto the support plate 54 by means of screws used instead of the screws 52. If this power take-off location is not in use, the opening 54*a* is closed by a cover 58.

The openings 54*b* in the support plate 54 receives the end of a control shaft (cam shaft) 60 which is journalled in the crankcase 14 and which, in a known manner, carries a cam 60*a* for driving the actuating means for the inlet and exhaust valves of the engine. A cam element 62 is pressed into an axially central bore 60*b* in the control shaft 60, and a manual starting crank may be brought into engagement with the cam element 62 in a known manner when starting the engine by hand. Furthermore, the front end of the control shaft 60 has several screw-threaded bores 60*e* which serve to secure a stub shaft (not illustrated). The stub shaft is centered in the bore 60*d* of the control shaft 60 and has a drive cam from which the drive for an auxiliary unit may be taken. The periphery of the control shaft 60 is also in the form of a gear wheel 60*c* which meshes with the crankshaft gear wheel 18*z* and transmits torque to the control shaft.

A further opening 54*c* in the support plate 54 is provided for insertion of a gear wheel (not illustrated) which meshes with the gear wheel 60*c* and which may be used to drive a further auxiliary unit, such as a hydraulic pump. When not in use, the opening 54*c* may be closed by means of a cover 162.

Finally, an opening 54*d* is provided in the support plate 54 and, after a cover 64 has been removed, enables access to the bottom region of the crankcase 24 to, for example, adjust a centrifugal governor accommodated therein.

After the cover 48 has been removed from the panel 24, the openings 24*f* and 44*ff* allow free access to the control side of the engine and the power take-off facilities provided there. On the other hand, the entire engine housing together with the casing may be used for self-supporting attachment to an auxiliary unit by means of the support plate 54 and the attachment connections provided therein. This attachment facility constitutes an advantageous supplement to the known possibility of flange-mounting the engine housing by way of the flywheel side of the crankcase.

When the cover 48 has been removed, only the slight emission of sound by the support plate 54 can reach the open air through the openings 44*ff* and 24*f* in the panel 24, and not, for example, some of the sound emitted by the engine itself, since the cover plate 56 prevents the direct egress of sound from the interior of the casing. On the other hand, if the openings 44*ff* and 24*f* are closed by the cover 48, the latter element itself damps the sound emitted by the support plate 54. This damping effect may be increased by a sound-damping layer mounted on the inside of the cover 48.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An internal combustion engine having a casing which comprises interconnected elements and is connected to an engine housing with interposed vibration-damping means, said engine having a cooling air blower driven by an engine crankshaft which draws in cooling air through an inlet opening in said casing and conveys such cooling air through an interior space between the engine housing and the casing, the exhaust air from such interior space exiting through an outlet opening in said casing, said inlet and outlet openings being disposed in a single element of the casing which element is disposed as a closure for said casing at a side of the engine remote from the blower and is equipped with at least one sound-damping layer, said sound damping layer having casing element passages formed therein which are separate from one another and communicate said interior space respectively with the inlet and outlet openings, and including across openings provided in said casing element and in its sound-damping layer in a region of the end of the crankshaft remote from the blower, which access openings are closable by a removable cover which, after it has been removed, affords access to transmission means which are disposed in said region and are coupled to the crankshaft for driving external units.

2. The internal combustion engine as claimed in claim 1, in which the cover is secured directly to said casing element.

3. An internal combustion engine as claimed in claim 1, in which a part of the engine housing which faces the access openings carries a cover plate on which an edge of the sound-damping layer surrounding said access opening therein rests in a sealing manner.

4. An internal combustion engine having a casing which comprises interconnected elements and is connected to an engine housing with interposed vibration-damping means, said engine having a cooling air blower driven by an engine crankshaft which draws in cooling air through an inlet opening in said casing and conveys such cooling air through an interior space between the engine housing and the casing, the exhaust air from such interior space exiting through an outlet opening in said casing, said inlet and outlet openings being disposed in a single element of the casing which element is disposed as a closure for said casing at a side of the engine remote from the blower and is equipped with at least one sound-damping layer, said sound damping layer having casing element passages formed therein which are separate from one another and communicate said interior space respectively with the inlet and outlet openings.

5. An internal combustion engine having a casing which comprises interconnected elements and is connected to an engine housing with interposed vibration-damping means, said engine having a cooling air blower on a blower side thereof which is driven by an engine crankshaft and which draws in cooling air through an inlet opening in said casing and conveys such cooling air through an interior space between the engine housing and the casing, the exhaust air from such interior space exiting through an outlet opening in said casing, a single element of the casing is disposed as a closure thereof at a side of the engine opposite to the blower side and is equipped with at least one sound-damping layer, the single element being provided with said inlet and outlet openings formed therein, and said sound damping layer having passages formed therein which are separate from one another and communicate at one end with said interior space and at the other end with the respective inlet and outlet openings in said single element, and said sound damping layer extending continuously from said inlet opening to said outlet opening.

* * * * *

UNITED STATES PATENT AND TRADEMARK OFFICE

CERTIFICATE OF CORRECTION

PATENT NO. : 4 993 381

DATED : February 19, 1991

INVENTOR(S) : Erich ABSENGER

It is certified that error appears in the above-identified patent and that said Letters Patent is hereby corrected as shown below:

Column 5, line 2; replace "across" with ---access---.

Signed and Sealed this

Thirteenth Day of April, 1993

*Attest:*

STEPHEN G. KUNIN

*Attesting Officer*

*Acting Commissioner of Patents and Trademarks*